US010709247B1

(12) United States Patent
Leverett

(10) Patent No.: US 10,709,247 B1
(45) Date of Patent: Jul. 14, 2020

(54) CUSHION SET

(71) Applicant: MERITS HEALTH PRODUCTS CO., LTD., Taichung (TW)

(72) Inventor: David Leverett, Ringgold, GA (US)

(73) Assignee: MERITS HEALTH PRODUCTS CO., LTD., Taichung (TW)

( * ) Notice: Subject to any disclaimer, the term of this patent is extended or adjusted under 35 U.S.C. 154(b) by 0 days.

(21) Appl. No.: 16/363,001

(22) Filed: Mar. 25, 2019

(51) Int. Cl.
*A47C 27/18* (2006.01)
*A47C 7/35* (2006.01)
*A61G 5/10* (2006.01)
*A47C 27/08* (2006.01)

(52) U.S. Cl.
CPC ..... *A47C 7/35* (2013.01); *A47C 27/085* (2013.01); *A61G 5/1045* (2016.11)

(58) Field of Classification Search
CPC ..... A47C 27/15; A47C 27/14; A47C 7/18; A47C 27/144
See application file for complete search history.

(56) References Cited

U.S. PATENT DOCUMENTS 4,478,453 A * 10/1984 Schutz ..... B60N 2/2881 297/219.12
4,726,624 A * 2/1988 Jay ..... A47C 7/021 297/452.23
4,951,336 A * 8/1990 Silverman ..... A47C 7/18 297/452.27
4,993,090 A * 2/1991 Ranalli ..... A47D 15/006 2/69
5,018,790 A * 5/1991 Jay ..... A47C 7/021 297/452.26
5,390,384 A * 2/1995 Dinsmoor, III ..... A47C 7/021 5/654
5,395,162 A * 3/1995 Jay ..... A47C 4/54 297/452.25
5,397,517 A * 3/1995 Jay ..... B29C 44/06 156/211
5,513,899 A * 5/1996 Michaels ..... A47C 7/021 297/452.41
5,613,256 A * 3/1997 Hanson ..... A61G 5/1043 297/284.9
5,687,436 A * 11/1997 Denton ..... A47C 31/126 5/653
5,933,891 A * 8/1999 Nachod, III ..... A61G 5/1043 297/452.24
6,241,320 B1 * 6/2001 Chew ..... A47C 7/021 297/452.26
D463,701 S * 10/2002 Borcherding ..... D6/601
(Continued)

*Primary Examiner* — Shin H Kim
(74) *Attorney, Agent, or Firm* — Muncy, Geissler, Olds & Lowe, P.C.

(57) ABSTRACT

Provided is a cushion set including a pad, a filling pad, an envelope, and a support pad set. The pad has a first-tier sunken portion and a second-tier sunken portion. The filling pad is disposed in the second-tier sunken portion. The envelope is disposed on the pad. The envelope has a pocket-shaped body. A plurality of coupling portions is disposed at edges of the body. The support pad set includes an upper foam pad, a lower foam pad, and a soft gel pad. The support pad set is disposed in the body of the envelope. The soft gel pad corresponds in position to the filling pad of the second-tier sunken portion of the pad.

9 Claims, 4 Drawing Sheets

(56) References Cited

U.S. PATENT DOCUMENTS 6,625,831 B2 * 9/2003 Laughlin ..... B29C 66/131 128/845
6,687,934 B1 * 2/2004 Liao ..... A47C 7/029 5/654
6,842,926 B2 * 1/2005 Kuo ..... A47C 27/085 5/654
7,216,388 B2 * 5/2007 Bieganek ..... A61G 5/1043 5/653
7,373,678 B2 * 5/2008 Hetzel ..... A61G 5/1043 5/653
7,445,292 B2 * 11/2008 Moule ..... B60N 2/643 297/452.25
7,614,704 B2 * 11/2009 Whelan ..... A47C 7/021 297/452.25
8,371,650 B2 * 2/2013 King ..... B60N 2/2839 297/219.12
8,485,601 B2 * 7/2013 Fair ..... B62B 9/108 297/219.12
8,668,977 B2 * 3/2014 Callsen ..... A47C 27/085 428/158
9,021,637 B1 * 5/2015 Whelan ..... A61G 5/1043 5/654
9,125,493 B2 * 9/2015 Siekman ..... A47C 7/021
10,455,944 B2 * 10/2019 Chernin ..... A61G 5/124
10,575,665 B2 * 3/2020 Rosenberg ..... A47G 9/1081
2005/0110315 A1 * 5/2005 Littlehorn ..... B60N 2/2812 297/219.12
2005/0151410 A1 * 7/2005 Sprouse, II ..... A47C 7/14 297/452.41
2007/0236074 A1 * 10/2007 Rodriquez, Jr. ..... A47C 7/021 297/452.41
2009/0109661 A1 * 4/2009 Holderman ..... A47C 7/725 362/131
2013/0193738 A1 * 8/2013 Siekman ..... A47C 7/02 297/452.56
2018/0103763 A1 * 4/2018 Chernin ..... A61G 5/124
2019/0291802 A1 * 9/2019 Sung ..... B32B 7/12

* cited by examiner

CUSHION SET

BACKGROUND OF THE INVENTION

Technical Field

The present disclosure relates to buttock supporting equipment and, more particularly, to a cushion set with multiple levels of softness.

A cushion is a soft thing which a user sits on comfortably as it supports the user's buttocks sufficiently. However, the cushion does not give sufficient support to the buttocks of users who lead a sedentary lifestyle or have paralyzed lower limbs, and in consequence hipbones are under prolonged pressure to the detriment of blood circulations, leading to bedsores. Therefore, it is imperative to provide a solution.

BRIEF SUMMARY OF THE INVENTION

It is an objective of the present disclosure to provide a cushion set structured to give multiple degrees of support.

In order to achieve the above and other objectives, the present disclosure provides a cushion set comprising a pad, a filling pad, an envelope, and a support pad set. The pad has a first-tier sunken portion and a second-tier sunken portion. The filling pad is disposed in the second-tier sunken portion. The envelope is disposed on the pad. The envelope has a pocket-shaped body. A plurality of coupling portions is disposed at edges of the body. The support pad set includes an upper foam pad, a lower foam pad, and a soft gel pad. The support pad set is disposed in the body of the envelope. The soft gel pad corresponds in position to the filling pad of the second-tier sunken portion of the pad.

DETAILED DESCRIPTION OF THE INVENTION

Figure 1:
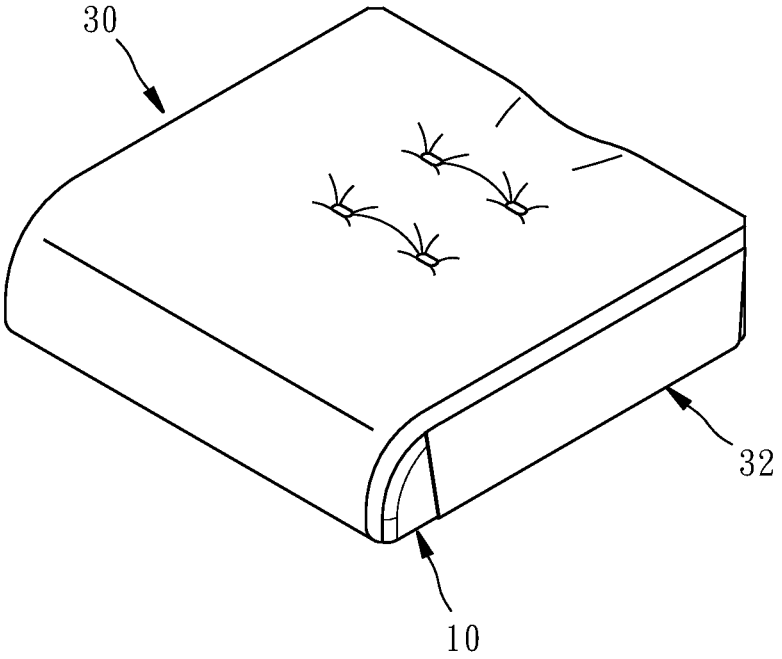
FIG. 1 is a perspective view of a cushion set of the present disclosure.
Figure 2:
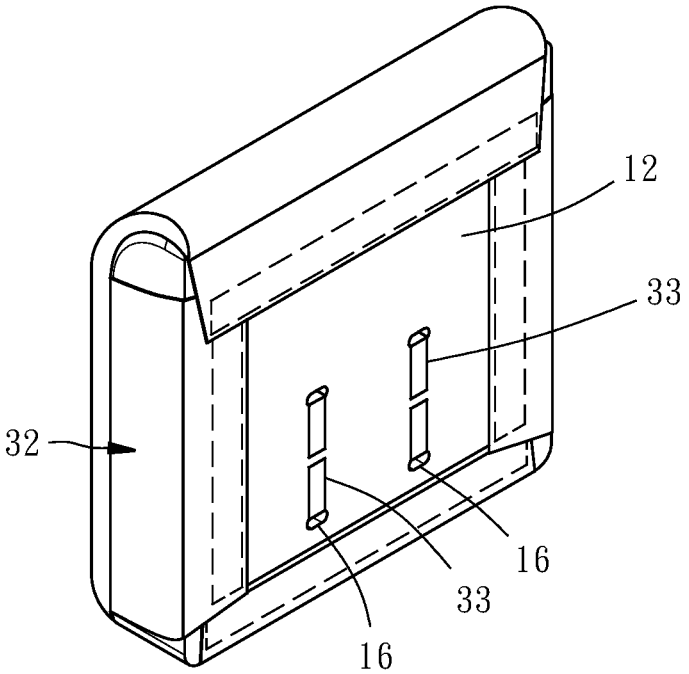
FIG. 2 is a perspective view of the cushion set from another angle according to the present disclosure.
Figure 3:
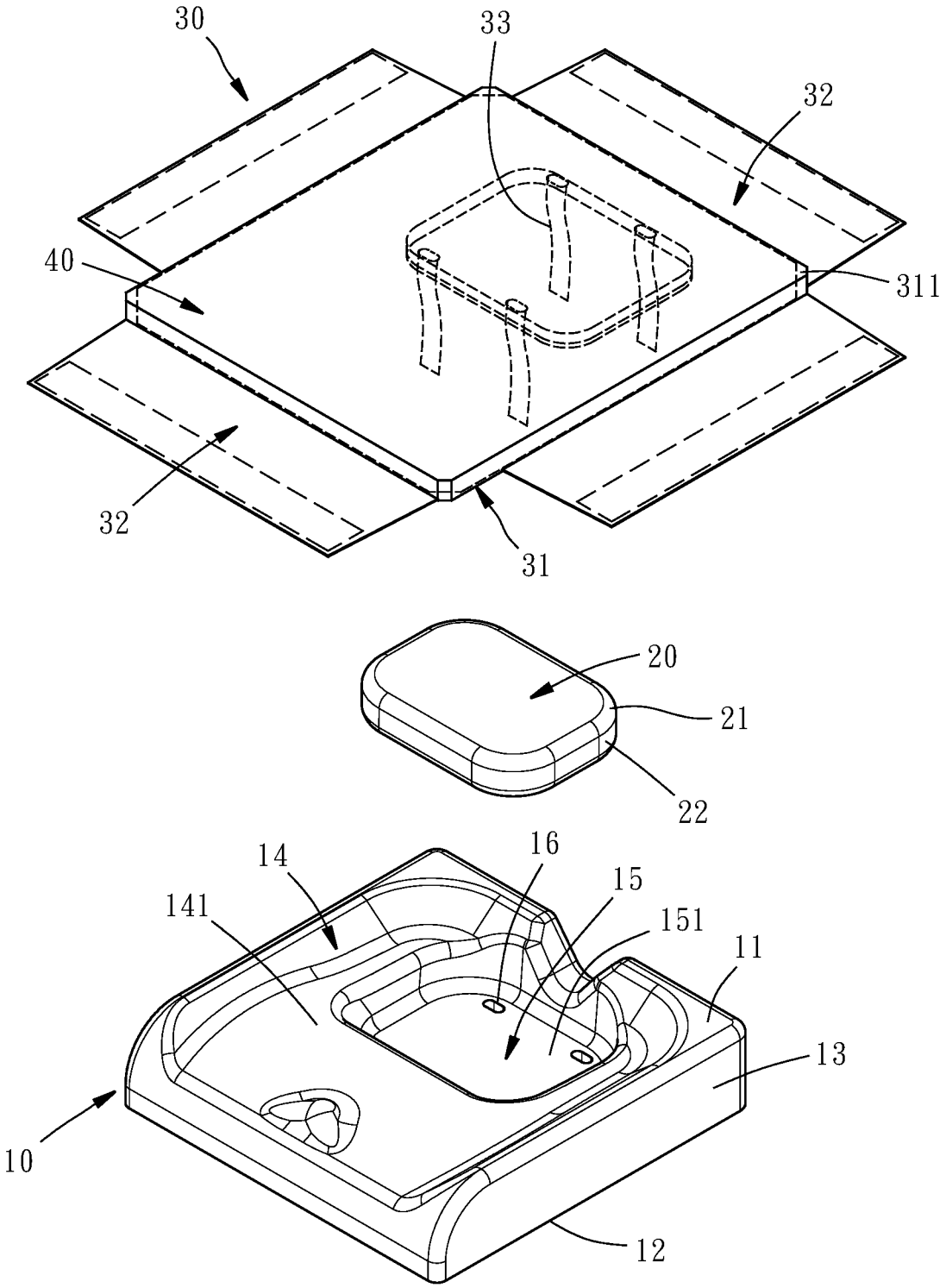
FIG. 3 is an exploded view of a pad and a filling pad of the cushion set of the present disclosure.
Figure 4:
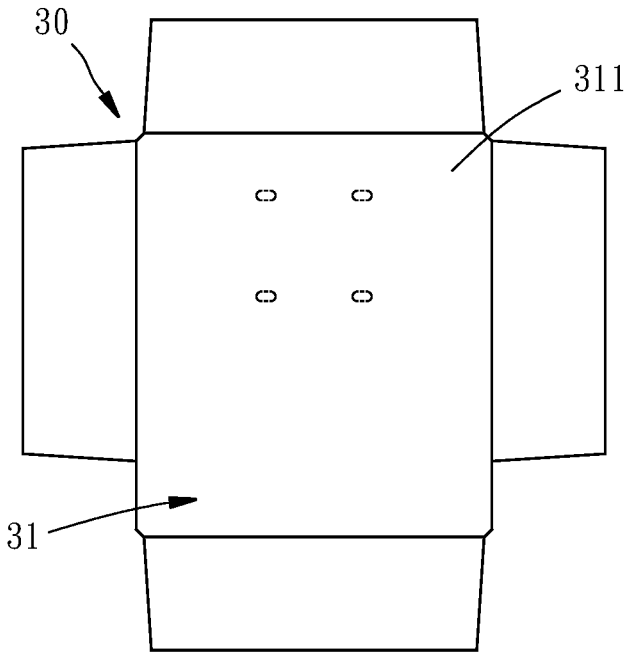
FIG. 4 is a front view of an envelope of the cushion set of the present disclosure.
Figure 5:
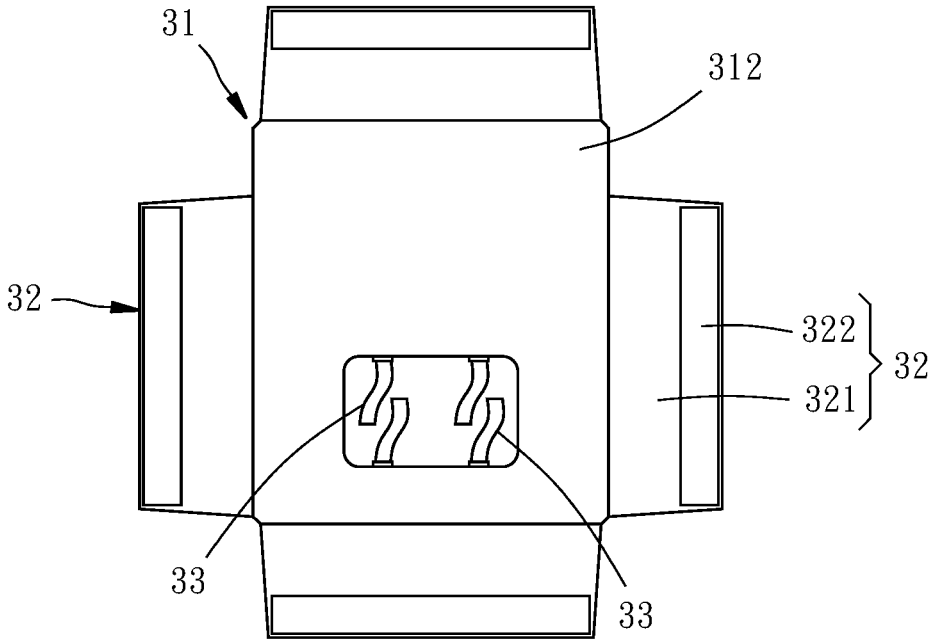
FIG. 5 is a rear view of the envelope of the cushion set of the present disclosure.
Figure 6:
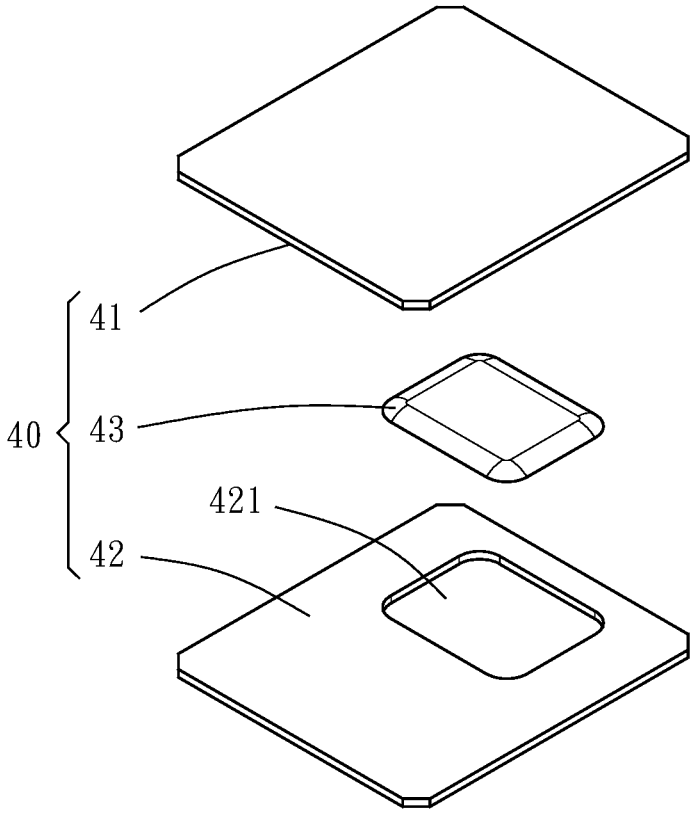
FIG. 6 is an exploded view of a support pad set of the cushion set of the present disclosure.

Referring to FIG. 1 through FIG. 6, a cushion set of the present disclosure comprises a pad 10, a filling pad 20, an envelope 30, and a support pad set 40.

The pad 10 is made of foam and has a top side 11, a bottom side 12, and a lateral side 13 disposed between the top side 11 and the bottom side 12 and surrounding the pad 10. The pad 10 sinks in the direction pointing from the top side 11 to the bottom side 12 to form a first-tier sunken portion 14. The first-tier sunken portion 14 has a bottom portion 141 such that a height difference is formed between the bottom portion 141 of the first-tier sunken portion 14 and the top side 11 of the pad 10. The upper edge of the first-tier sunken portion 14 sinks and tapers in the direction pointing from the top side 11 of the pad 10 to the bottom side 12 of the pad 10; hence, the upper edge of the first-tier sunken portion 14 is wider than the bottom portion 141 of the first-tier sunken portion 14. The pad 10 further sinks in the direction pointing from the bottom portion 141 of the first-tier sunken portion 14 to the bottom side 12 of the pad 10 to form a second-tier sunken portion 15 such that the second-tier sunken portion 15, the first-tier sunken portion 14, and the top side 11 of the pad 10 together form a three-tier structure. The second-tier sunken portion 15 has a bottom portion 151. The bottom portion 151 has a plurality of through holes 16 penetrating from the bottom portion 151 of the second-tier sunken portion to the bottom side 12 of the pad 10. In this embodiment, the pad 10 is made of high-density (3.5 Lb/ft$^3$~5 Lb/ft$^3$) foam polyurethane. The bottom portion 151 of the second-tier sunken portion has four through holes 16. The pad 10 is of such a shape that it is ergonomic for a sitting person and conducive to good posture and optimal pressure distribution.

The filling pad 20 is disposed in the second-tier sunken portion 15 of the pad 10. The filling pad 20 differs from the pad 10 in material and softness. In this embodiment, the filling pad 20 comprises an upper layer 21 and a lower layer 22. The upper layer is made from gel infused viscoelastic foam polyurethane (4 Lb/ft$^3$~6 Lb/ft$^3$) which is about 0.5 inches thick, with a penetration depth of 15-17 mm being confirmed by shore 00 hardness measurement. The lower layer is made from gel infused viscoelastic foam polyurethane (20 Lb IFD~24 Lb IFD) which is about 1.5 inches thick. IFD means Indentation Force Deflection.

The envelope 30 has a pocket-shaped body 31. The body 31 has an outer lateral side 311 and an inner lateral side 312. A plurality of coupling portions 32 is disposed at the edges of the body 31. In this embodiment, the body 31 is a rectangular cuboid, and a coupling portion 32 is disposed at each of its four edges. The coupling portions 32 each comprise a fabric 321 and a velcro strap 322. The fabric 321 is connected to the body 31, whereas the velcro strap 322 is disposed on the fabric 321, but the present disclosure is not limited thereto. In a variant embodiment, the coupling portions 32 each include a fabric and a button, include a fabric and a zipper, or include a velcro strap. A plurality of coupling bands 33 is disposed on the inner lateral side 312 of the body 31. The coupling bands 33 are each provided with a fastening portion and are paired. The fastening portions are fastened to each other. The envelope 30 corresponds in shape to the pad 10 substantially and is disposed on the top side 11 of the pad 10. The coupling portions 32 bend downward to therefore cover the lateral side 13 of the pad 10, then extend to therefore cover the bottom side 12 of the pad 10, and finally the velcro straps 322 of the coupling portions 32 are coupled to the bottom side 12 of the pad 10. The coupling bands 33 penetrate the through holes 16 of the second-tier sunken portion of the pad 10, respectively, and then are paired before being coupled together or fastened to the pad 10 by the fastening portions.

The support pad set 40 comprises an upper foam pad 41, a lower foam pad 42, and a soft gel pad 43. The upper foam pad 41 and the lower foam pad 42 correspond in shape to the pad 10 substantially. The lower foam pad 42 has a receiving hole 421. The soft gel pad 43 is disposed in the receiving hole 421. The support pad set 40 is disposed in the body 31 of the envelope 30. The soft gel pad 43 corresponds in position to the second-tier sunken portion 15 of the pad 10. The upper foam pad 41 is made of gel infused viscoelastic foam polyurethane (4 Lb/ft$^3$~6 Lb/ft$^3$). The upper foam pad 41 provides comfort and promotes blood circulation. The soft gel pad 43 is made of high-viscosity silica gel to not only relieve the pressure otherwise imposed on ischium and coccyx but also prevent shear force. The two advantages are conducive to prevention of bedsores. The lower foam pad 42 is made of high-density, high-elasticity foam polyurethane (54 Lb IFD 58 Lb IFD) and covers the edges of the soft gel pad 43 to exert an upward, supportive force on the greater trochanter of femur from below and thus sink further into the soft gel pad 43 so as to reduce the pressure otherwise imposed on ischial tuberosity and coccyx. The soft gel pad 43 of the support pad set 40 is a good pressure-relieving zone for eliminating the pressure otherwise imposed on the coccyx and ischium to provide comfort and prevent bedsores.

The cushion set of the present disclosure is advantageous in that the pad operates in conjunction with the filling pad and the support pad set to therefore has multiple levels of softness. While a user is sitting on the pad, the pad gives different degrees of support to different parts of the user's buttocks, for example, supporting the ischium with the soft gel pad of the support pad set and the filling pad. Furthermore, both the pad and the support pad set can be independently changed to enable different combinations.

What is claimed is:

1. A cushion set, comprising:

a pad having a top side, a bottom side, and a lateral side disposed between the top side and the bottom side to surround the pad, the pad sinking in a direction pointing from the top side to the bottom side to form a first-tier sunken portion, the first-tier sunken portion having a bottom portion, the pad further sinking in a direction pointing from the bottom portion of the first-tier sunken portion to the bottom side of the pad to form a second-tier sunken portion, with a plurality of through holes disposed at the bottom portion of the second-tier sunken portion and penetrating from the bottom portion of the second-tier sunken portion to the bottom side of the pad;

a filling pad disposed in the second-tier sunken portion of the pad;

an envelope having a pocket-shaped body with an outer lateral side and an inner lateral side, the envelope covering the top side of the pad, wherein a plurality of coupling portions is disposed at edges of the body and bends downward to therefore cover the pad, wherein a plurality of coupling bands is disposed on the inner lateral side of the body and penetrates the through holes of the pad, respectively; and a support pad set comprising an upper foam pad, a lower foam pad, and a soft gel pad, the support pad set being disposed in the body of the envelope, the soft gel pad corresponding in position to the second-tier sunken portion of the pad.

2. The cushion set of claim 1, wherein the lower foam pad has a receiving hole, and the soft gel pad is disposed in the receiving hole.

3. The cushion set of claim 2, wherein the coupling portions bend downward to therefore cover the lateral side of the pad and extend to therefore the bottom side of the pad.

4. The cushion set of claim 3, wherein the coupling portions each comprise a fabric and a velcro strap, the fabric being connected to the body, and the velcro strap being disposed on the fabric.

5. The cushion set of claim 4, wherein the velcro straps of the coupling portions are coupled to the bottom side of the pad.

6. The cushion set of claim 1, wherein the coupling bands are each provided with a fastening portion and are paired, the fastening portions being fastened to each other.

7. The cushion set of claim 4, wherein the coupling bands are each provided with a fastening portion and are paired, the fastening portions being fastened to each other.

8. The cushion set of claim 1, wherein the filling pad differs from the pad in material and softness.

9. The cushion set of claim 4, wherein the filling pad differs from the pad in material and softness.

* * * * *